US009459582B2

(12) United States Patent
Hamano et al.

(10) Patent No.: US 9,459,582 B2
(45) Date of Patent: Oct. 4, 2016

(54) IMAGE FORMING APPARATUS INCLUDING VOLTAGE AND CURRENT APPLICATION LINES

(71) Applicants: Toshihiro Hamano, Tokyo (JP); Norio Joichi, Tokyo (JP)

(72) Inventors: Toshihiro Hamano, Tokyo (JP); Norio Joichi, Tokyo (JP)

(73) Assignee: RICOH COMPANY, LIMITED, Tokyo (JP)

( * ) Notice: Subject to any disclaimer, the term of this patent is extended or adjusted under 35 U.S.C. 154(b) by 0 days.

(21) Appl. No.: 14/924,854

(22) Filed: Oct. 28, 2015

(65) Prior Publication Data

US 2016/0124373 A1 May 5, 2016

(30) Foreign Application Priority Data

Oct. 31, 2014 (JP) ..... 2014-223320

(51) Int. Cl.
*G03G 15/00* (2006.01)

(52) U.S. Cl.
CPC ..... *G03G 15/80* (2013.01)

(58) Field of Classification Search
CPC ..... G03G 15/80
USPC ..... 399/88–91, 107
See application file for complete search history.

(56) References Cited

U.S. PATENT DOCUMENTS 5,918,089 A * 6/1999 Malinich et al. ..... G03G 15/80 399/90
7,266,321 B2 * 9/2007 Ahn et al. ..... G03G 15/065 399/90
7,873,294 B2 * 1/2011 Nobe et al. ..... G03G 15/5004 399/88
8,891,996 B2 * 11/2014 Fujita et al. ..... G03G 15/00 399/88
9,037,031 B2 * 5/2015 Masuda ..... G03G 15/80 399/90
2011/0097094 A1 4/2011 Hamano et al.

FOREIGN PATENT DOCUMENTS

JP 09-218565 8/1997

* cited by examiner

*Primary Examiner* — William J Royer
(74) *Attorney, Agent, or Firm* — Harness, Dickey & Pierce, P.L.C.

(57) ABSTRACT

An image forming apparatus includes a voltage application unit, a target device, a voltage application line, and an electric-current return line. The voltage application unit applies a voltage to the target device through the voltage application line made of a conductor. The electric-current return line made of a conductor connects the target device to the voltage application unit. An electric current that flows upon application of the voltage from the voltage application unit to the target device returns to the voltage application unit through the electric-current return line. The electric-current return line has a length shorter than a path by way of the casing of the image forming apparatus.

5 Claims, 4 Drawing Sheets

IMAGE FORMING APPARATUS INCLUDING VOLTAGE AND CURRENT APPLICATION LINES

CROSS-REFERENCE TO RELATED APPLICATIONS

The present application claims priority to and incorporates by reference the entire contents of Japanese Patent Application No. 2014-223320 filed in Japan on Oct. 31, 2014.

BACKGROUND OF THE INVENTION

1. Field of the Invention

The present invention relates generally to image forming apparatuses.

2. Description of the Related Art

An electrophotographic image forming apparatus typically transfers toner by using a high-voltage AC (alternating current) power supply when transferring a latent image developed with the toner on a photoconductor drum to an intermediate transfer belt. More specifically, a high voltage is applied to transfer the toner from a high-voltage power-supply generating circuit to the target device through a high-voltage AC harness. An image forming apparatus body (i.e., a casing of the image forming apparatus) is typically used as a return line, by which an electric current that flows upon application of the high voltage returns to the high-voltage power-supply generating circuit.

Japanese Laid-open Patent Application No. H9-218565 discloses a high-voltage power-supply device made by housing a high voltage transformer, a high voltage rectifier, a high voltage lead, and a ferrite core in a casing and vacuum impregnating the casing with insulating resin. This high-voltage power-supply device is capable of reducing electromagnetic noise emitted due to corona discharge from a discharge wire, which is a load where a high voltage is applied, with a minimum increase in size of space around the ferrite core.

SUMMARY OF THE INVENTION

According to an aspect of the present invention, there is provided an image forming apparatus including: a voltage application unit configured to apply a voltage; a target device, to which the voltage is to be applied; a voltage application line, through which the voltage is applied from the voltage application unit to the target device, the voltage application line being made of a conductor; and an electric-current return line, through which an electric current that flows upon application of the voltage from the voltage application unit to the target device returns to the voltage application unit, made of a conductor and connecting the target device to the voltage application unit, the electric-current return line having a length shorter than a path by way of a casing of the image forming apparatus.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are described in detail below with reference to the accompanying drawings.

In summary, an image forming apparatus according to an embodiment includes a wire harness (hereinafter, "harness") or the like between a high-voltage power-supply generating circuit and a target device to provide the target device with a route of a return line, by which an electric current that flows upon application of a high voltage to the target device returns to the high-voltage power-supply circuit. This route is made of a conductor such as a harness in a length shorter than a length of a return line formed by using a casing of the image forming apparatus. The length of this route is other than any integer multiple of wavelength of switching frequency of the high-voltage power-supply generating circuit. The length of this route is minimum length for connecting the high-voltage power-supply generating circuit to the target device or a length close to the minimum length. The image forming apparatus configured as described above can prevent an inconvenience that the route resonates at the switching frequency of the high-voltage power-supply generating circuit, and therefore can reduce noise emitted from the casing of the image forming apparatus.

Figure 1:
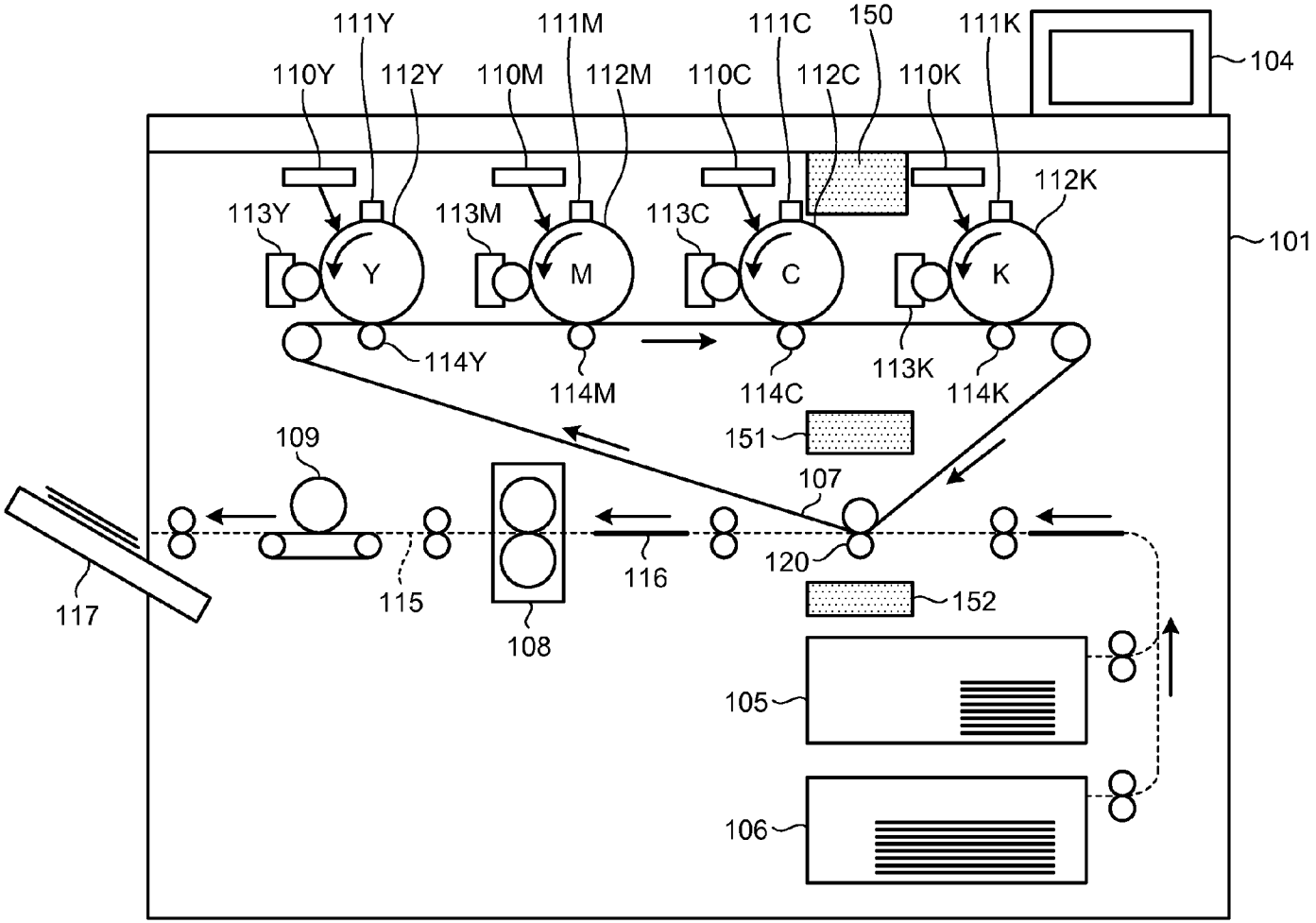
FIG. 1 is a schematic configuration diagram of an image forming apparatus according to an embodiment.

FIG. 1 is a schematic configuration diagram of an image forming apparatus 101 according to an embodiment. The image forming apparatus according to the embodiment may be embodied as, for example, an image forming apparatus capable of full-color printing using four colors (C (cyan), M (magenta), Y (yellow), and K (black)). For brevity of illustration, a paper ejecting-and-reversing path and the like for use in duplex printing are omitted from FIG. 1.

As illustrated in FIG. 1, the image forming apparatus 101 includes an operation panel 104, paper feeding trays 105 and 106, an intermediate transfer belt 107, a fixing device 108, a cooling roller 109, a paper ejection tray 117, and a secondary transfer roller 120. The image forming apparatus 101 further includes laser scanning units 110Y, 110M, 110C, and 110K and charging devices 111Y, 111M, 111C, and 111K for the four colors (C (cyan), M (magenta), Y (yellow), and K (black)), respectively. The image forming apparatus 101 further includes photoconductor drums 112Y, 112M, 112C, and 112K, developing devices 113Y, 113M, 113C, and 113K, and primary transfer rollers 114Y, 114M, 114C, and 114K.

Sheets 116 of print media (hereinafter, "sheets") are housed in each of the paper feeding trays 105 and 106. The image forming apparatus 101 performs printing to produce a printout according to a print execution instruction entered from the operation panel 104. More specifically, the image forming apparatus 101 obtains data from a reading device (hereinafter, "scanner") or an external entity. The obtained image data is subjected to image processing performed by an image processing board, so that latent images are formed.

The latent images are formed using the photoconductor drums 112Y, 112M, 112C, and 112K arranged in an image formation unit. A charging high-voltage power supply 150 applies a high voltage to the charging devices 111Y, 111M, 111C, and 111K, which in turn uniformly deposit charges on the photoconductor drums 112Y, 112M, 112C, and 112K. For example, a high voltage of −700 kV (kilovolts) with a minute electric current is uniformly applied to the photoconductor drums 112Y, 112M, 112C, and 112K. The photoconductor drums 112Y, 112M, 112C, and 112K thus become ready for writing latent images thereto.

Thereafter, the laser scanning units 110Y, 110M, 110C, and 110K irradiate the charged photoconductor drums 112Y, 112M, 112C, and 112K with laser light in accordance with the image data. As a result, potential levels at portions, which are irradiated with the laser light, of the uniformly-charged photoconductor drums 112Y, 112M, 112C, and 112K drop to approximately −400 kV, for example. The latent images are written with such difference in potential level developed by the laser light irradiation. An exposure process is performed in this manner.

Thereafter, toner is applied to the photoconductor drums 112Y, 112M, 112C, and 112K where the latent images are written. Whereas the toner remains on the portions where the potential level is lowered by the laser light irradiation, the toner does not remain on portions, which are not irradiated with the laser light. A developing process is performed in this manner. These processes are performed on a color-by-color basis (Y, M, C, and K). As a result, toner latent images of the respective colors (Y, M, C, and K) in accordance with the image data are respectively formed on the photoconductor drums 112Y, 112M, 112C, and 112K.

Thereafter, the toner latent images written to and formed on the photoconductor drums 112Y, 112M, 112C, and 112K by application of the toner of the respective colors are transferred one by one onto the intermediate transfer belt 107. Meanwhile, the toner latent images on the photoconductor drums 112Y, 112M, 112C, and 112K cannot be transferred onto the intermediate transfer belt 107 only by simply overlaying the toner latent images on one another on the intermediate transfer belt 107. The toner latent images can be transferred onto the intermediate transfer belt 107 in the following manner. The photoconductor drums 112Y, 112M, 112C, and 112K and the intermediate transfer belt 107 are respectively rotated at a fixed speed. In addition, a voltage is applied from a primary-transfer high-voltage power supply 151 arranged in a primary transfer unit to the primary transfer rollers 114Y, 114M, 114C, and 114K.

As a result, the primary transfer rollers 114Y, 114M, 114C, and 114K bear negative charges, which cause the positively-charged toner on the photoconductor drums 112Y, 112M, 112C, and 112K to be attracted onto the intermediate transfer belt 107. Accordingly, the toner latent images of the respective colors formed on the photoconductor drums 112Y, 112M, 112C, and 112K are attracted and transferred onto the intermediate transfer belt 107. While the transfer process described above is performed for each of the colors (Y, M, C, and K) in color printing, the transfer process will be performed only for K in monochrome printing.

Thereafter, the intermediate transfer belt 107 is rotated by an intermediate transfer motor to convey the toner latent images of the respective colors transferred onto the intermediate transfer belt 107 to a contact position between the intermediate transfer belt 107 and the secondary transfer roller 120. One of the sheets 116 placed in a stack in the paper feeding tray 105 is conveyed to the secondary transfer roller 120 timed to when the toner latent images are conveyed to the secondary transfer roller 120. The toner latent images of the respective colors are transferred onto the sheet 116 at the position of the secondary transfer roller 120. More specifically, a high voltage is applied from a secondary-transfer high-voltage power supply 152 to the secondary transfer roller 120 to cause the secondary transfer roller 120 to bear negative charges. The negative charges cause the toner latent images on the intermediate transfer belt 107 to be attracted and transferred onto the sheet 116. The sheet 116, onto which the toner latent images are transferred, is conveyed by a conveying belt 115 and ejected onto the paper ejection tray 117 after passing through the fixing device 108 and the cooling roller 109.

The charging high-voltage power supply 150, the primary-transfer high-voltage power supply 151, and the secondary-transfer high-voltage power supply 152 are an example of "voltage application unit". Each of the charging devices 111Y, 111M, 111C, and 111K, the primary transfer rollers 114Y, 114M, 114C, and 114K, and the secondary transfer roller 120 is an example of "target device".

The charging high-voltage power supply 150 is connected to the charging devices 111Y, 111M, 111C, and 111K, respectively, with harnesses. The charging high-voltage power supply 150 applies a high voltage through the harnesses to the charging devices 111Y, 111M, 111C, and 111K, so that the charging devices 111Y, 111M, 111C, and 111K deposit charges on the photoconductor drums 112Y, 112M, 112C, and 112K, respectively. Similarly, the primary-transfer high-voltage power supply 151 is connected to the primary transfer rollers 114Y, 114M, 114C, and 114K, respectively, with harnesses. The primary-transfer high-voltage power supply 151 applies a high voltage to the primary transfer rollers 114Y, 114M, 114C, and 114K, respectively, through the harnesses, so that the primary transfer rollers 114Y, 114M, 114C, and 114K bear negative charges. Similarly, the secondary-transfer high-voltage power supply 152 is connected to the secondary transfer roller 120 with a harness. The secondary-transfer high-voltage power supply 152 applies a high voltage to the secondary transfer roller 120 through the harness, so that the secondary transfer roller 120 bears negative charges.

Figure 2:
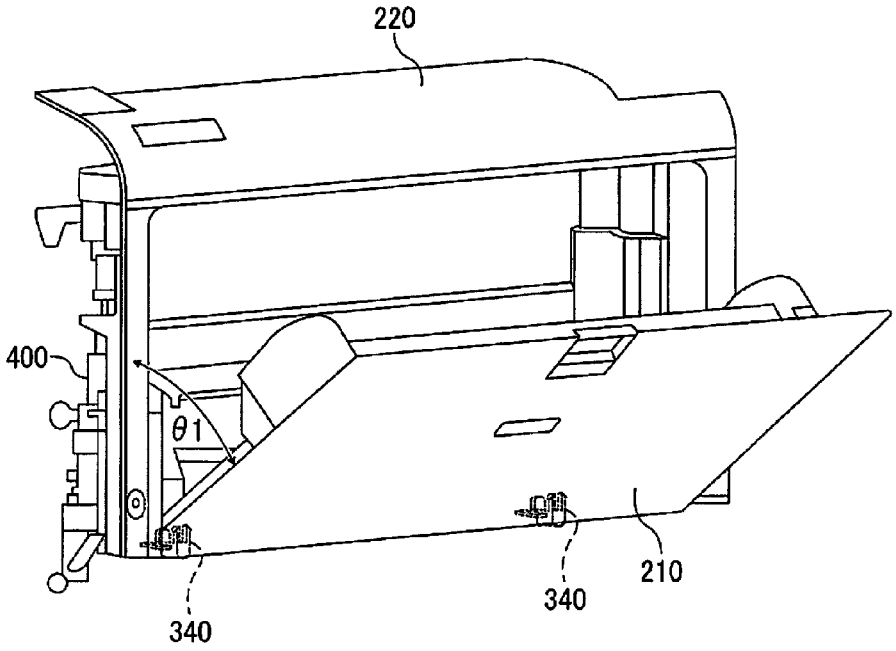
FIG. 2 Prior Art
FIG. 2 is a perspective view of photoconductor drums and components around the drums of a typical image forming apparatus.

A typical image forming apparatus returns an electric current that flows upon application of a high voltage across photoconductor drums and the like to a high-voltage power supply by using a casing of the image forming apparatus as a return line. FIG. 2 is a perspective view of an example of photoconductor drums and components around the drums of a typical image forming apparatus. The typical image forming apparatus illustrated in FIG. 2 includes photoconductor drums 200Y, 200M, 200C, and 200K for the four colors (C (cyan), M (magenta), Y (yellow), and K (black)) as does the image forming apparatus according to the embodiment. Each of the photoconductor drums 200Y, 200M, 200C, and 200K includes a charging device.

A high-voltage power supply 201YM is a high-voltage power supply for applying a voltage to the photoconductor drum 200Y and the photoconductor drum 200M. The high-voltage power supply 201YM is connected to the charging device included in the photoconductor drum 200Y and that included in the photoconductor drum 200M via harnesses. The high-voltage power supply 201YM applies a high voltage to the charging device included in the photoconductor drum 200Y and that in the photoconductor drum 200M through the harnesses. The dashed-line arrows in FIG. 2 indicate how the high voltage is applied from the high-voltage power supply 201YM to the charging device of the photoconductor drum 200M through the harness (not shown). The photoconductor drum 200Y and the photoconductor drum 200M are thus charged via the charging devices.

Similarly, a high-voltage power supply 201CK is a high-voltage power supply for applying a voltage to the photoconductor drum 200C and the photoconductor drum 200K. The high-voltage power supply 201CK is connected to the charging device included in the photoconductor drum 200C and that included in the photoconductor drum 200K via harnesses. The high-voltage power supply 201CK applies a high voltage to the charging device included in the photoconductor drum 200C and that in the photoconductor drum 200K through the harnesses. The photoconductor drum 200C and the photoconductor drum 200K are thus charged via the charging devices.

The solid-line arrows in FIG. 2 indicate a return line, by which an electric current that flows upon application of the high voltage for depositing charges on the photoconductor drum 200M returns to the high-voltage power supply 201YM. As indicated by the solid-line arrows, the electric current that flows upon application of the high voltage for depositing charges on the photoconductor drum 200M flows first to a frame 203, then to a frame 204, then to a frame 205, and then to a frame 202 of the casing of the image forming apparatus to finally return to the high-voltage power supply 201YM. Other return lines, by which electric currents that flow upon application of a high voltage for depositing charges on the other photoconductor drums return, are similar to the above-described return line.

As is apparent from the high-voltage supply line indicated by the dashed-line arrows in FIG. 2 and the return line, by which the electric current that flows upon application of the high voltage returns to the high-voltage power supply 201YM, indicated by the solid-line arrows in FIG. 2, the electric current flows as follows: from the high-voltage power supply 201YM to the photoconductor drum 200M, then to the frame 203, then to the frame 204, then to the frame 205, then to the frame 202, and finally to the high-voltage power supply 201YM. Hence, the electric current flows through a large looped path. This looped path forms a loop-antenna equivalent. Put another way, a large loop antenna, the output source of which is the high-voltage power supply 201YM, is formed. Furthermore, when the casing is used as the current return line, route of this return line can vary depending on an assembly condition of the casing including individual difference of each casing and how tightly a screw(s) is fastened. Accordingly, an image forming apparatus using its casing as the return line can have a problem that the return line is unstable.

Furthermore, in a case where the casing of the image forming apparatus is large, using the casing as the return line can increase the length of the return line, by which a current returns from a target device where a high voltage is applied. In the image forming apparatus of the embodiment, the target device where a high voltage is to be applied includes, for example, not only the charging devices 111Y, 111M, 111C, and 111K for depositing charges on the photoconductor drums 112Y, 112M, 112C, and 112K illustrated in FIG. 1 but also the primary transfer rollers 114Y, 114M, 114C, and 114K, and the secondary transfer roller 120.

Furthermore, the shape (structure) of the casing of the image forming apparatus and hence the length and the route of the return line vary between a condition where the paper feeding tray 105, 106, or the like is open and a condition where the paper feeding tray 105, 106, or the like is closed. Furthermore, such a change in the shape (structure) of the casing of the image forming apparatus can result in a largely-detoured return route in some cases.

A high-voltage power supply generates a predetermined high voltage and applies a voltage by performing power-supply switching regulation on a board. However, if switching frequency of the high-voltage power supply and resonance frequency of the loop-antenna equivalent formed by the current return line coincides with each other, noise whose frequency is an integer multiple of the switching frequency can be emitted from the casing of the image forming apparatus.

More specifically, if the length of the antenna equivalent formed by the current return line is similar to the wavelength (or an integer multiple of the wavelength) of the switching frequency of the high-voltage power supply, the antenna formed by the return line resonates at the switching frequency, thereby radiating noise to the outside of the image forming apparatus.

To prevent this inconvenience, the image forming apparatus according to the embodiment does not use the casing as the current return line, by which currents that flow upon application of the high voltage return to the high-voltage power supply, but connects the target device where a high voltage is to be applied to the high-voltage power supply with harnesses dedicated to current return lines.

Figure 3:
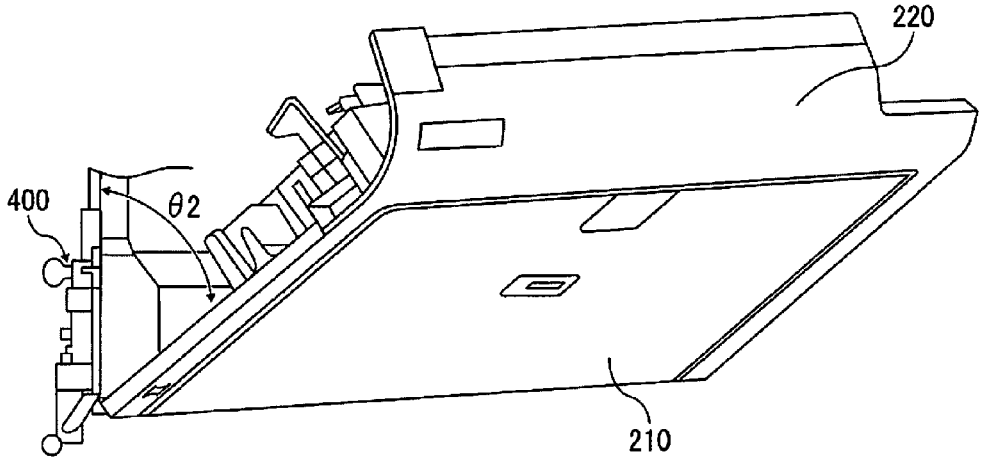
FIG. 3 is a perspective view of photoconductor drums and components around the drums of the image forming apparatus according to the embodiment.

FIG. 3 is a perspective view of the photoconductor drums and components around the drums 112Y, 112M, 112C, and 112K of the image forming apparatus 101 according to the embodiment. As illustrated in FIG. 3, in the image forming apparatus 101 according to the embodiment, a high-voltage power supply 150YM and the photoconductor drum 112M are connected with a harness 180 dedicated to a current return line, by which a current that flows upon application of a high voltage returns to the high-voltage power supply 150YM. Although not shown, similarly, the high-voltage power supply 150YM is connected to the photoconductor drum 112Y with a harness dedicated to a current return line, by which a current that flows upon application of a high voltage returns to the high-voltage power supply 150YM. A high-voltage power supply 150CK is connected to the photoconductor drum 112C with a harness dedicated to a current return line, by which a current that flows upon application of a high voltage returns to the high-voltage power supply 150CK. The high-voltage power supply 150CK is connected to the photoconductor drum 112K with a harness dedicated to a current return line, by which a current that flows upon application of a high voltage returns to the high-voltage power supply 150CK.

The dashed-line arrows in FIG. 3 indicate a high-voltage application line (which is an example of "voltage application line"), through which a high voltage is applied from the high-voltage power supply 150YM to the charging device 111M so that the charging device 111M deposits charges on the photoconductor drum 112M. The high-voltage application on the charging device 111M is performed through the harness dedicated to the application. Hence, the high-voltage power supply 150YM and the photoconductor drum 112M (and hence the charging device 111M) are connected to each other with the two harnesses, which are the above-described harness 180 dedicated to the current return line and the harness dedicated to the high-voltage application. The harness 180 is an example of "electric-current return line".

If both the harness 180 dedicated to the current return line and the harness dedicated to the high-voltage application are depicted in FIG. 3, FIG. 3 will be complicated. To avoid this, only the harness 180 dedicated to the current return line is depicted in FIG. 3, and the high-voltage application path, by which the high voltage is applied through the harness dedicated to the high-voltage application, is indicated by the dashed-line arrows.

Similarly, the high-voltage power supply 150YM and the photoconductor drum 112Y (and hence the charging device 111Y) are connected to each other with the two harnesses, which are the harness dedicated to the current return line and the harness dedicated to the high-voltage application. Similarly, the high-voltage power supply 150CK and the photoconductor drum 112C (and hence the charging device 111C) are connected to each other with the two harnesses, which are the harness dedicated to the current return line and the harness dedicated to the high-voltage application. Similarly, the high-voltage power supply 150CK and the photoconductor drum 112K (and hence the charging device 111K) are connected to each other with the two harnesses, which are the harness dedicated to the current return line and the harness dedicated to the high-voltage application.

In the image forming apparatus 101 according to the embodiment configured as described above, an electric current flows from the high-voltage power supply 150YM to the charging device 111M for depositing charges on the photoconductor drum 112M via the path indicated by the dashed-line arrows in FIG. 3 through the harness dedicated to the high-voltage application. Thereafter, the current returns to the high-voltage power supply 150YM via the path indicated by the solid-line arrows in FIG. 3 through the harness 180 dedicated to the return line placed between the photoconductor drum 112M and the high-voltage power supply 150YM. Hence, the current that flows upon application of the high voltage returns to the high-voltage power supply 150YM through the harness 180 rather than through the frames 161 to 164 of the image forming apparatus 101.

As described above, the harness dedicated to the high-voltage application and the harness 180, which is substantially identical in length with the harness dedicated to the high-voltage application, dedicated to the current return line are placed between the high-voltage power supply and the target device where the high voltage is applied. The current return line, by which the current returns to the high-voltage power supply 150YM, can thus be obtained. Accordingly, even if the shape (structure) of the casing of the image forming apparatus varies between a condition where the paper feeding tray 105, 106, or the like is open and a condition where the paper feeding tray 105, 106, or the like is closed, the length and the route of the return line can be maintained invariant (unchanged).

How to determine the harness length of the harness 180, which forms the current return line, is described below. If the length of the above-described current return line is increased by use of the casing as the return line as in a typical image forming apparatus, the length of the looped path of the current increases. As a result, the shape of the antenna equivalent (loop antenna) increases. Hence, as the length of the return line increases, the loop antenna functions more as an antenna or, more specifically, radiation capability as an antenna increases.

Figure 4:
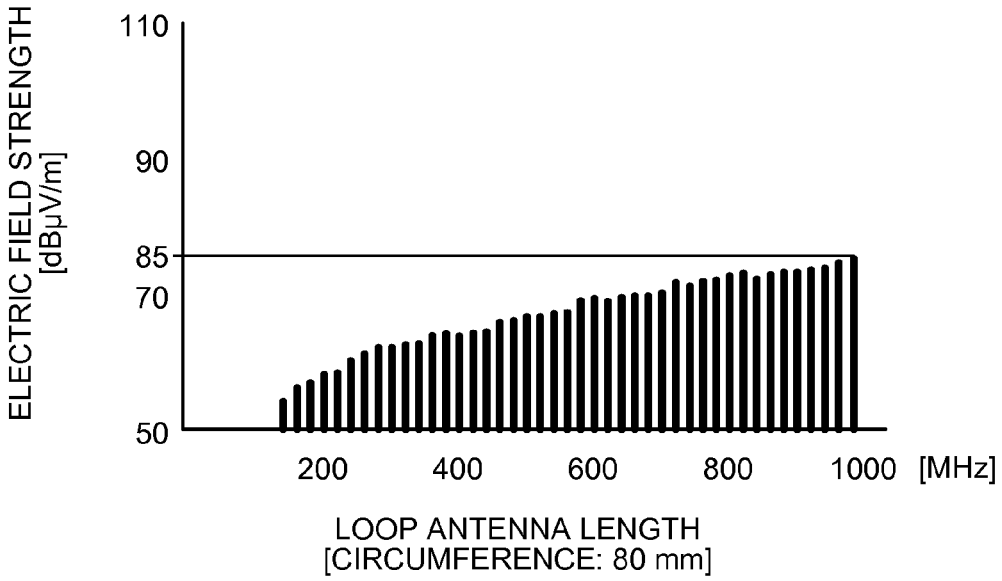
FIG. 4 is a diagram illustrating relationship between frequency and electric field strength of a loop antenna whose length is 80 mm (millimeters)
Figure 5:
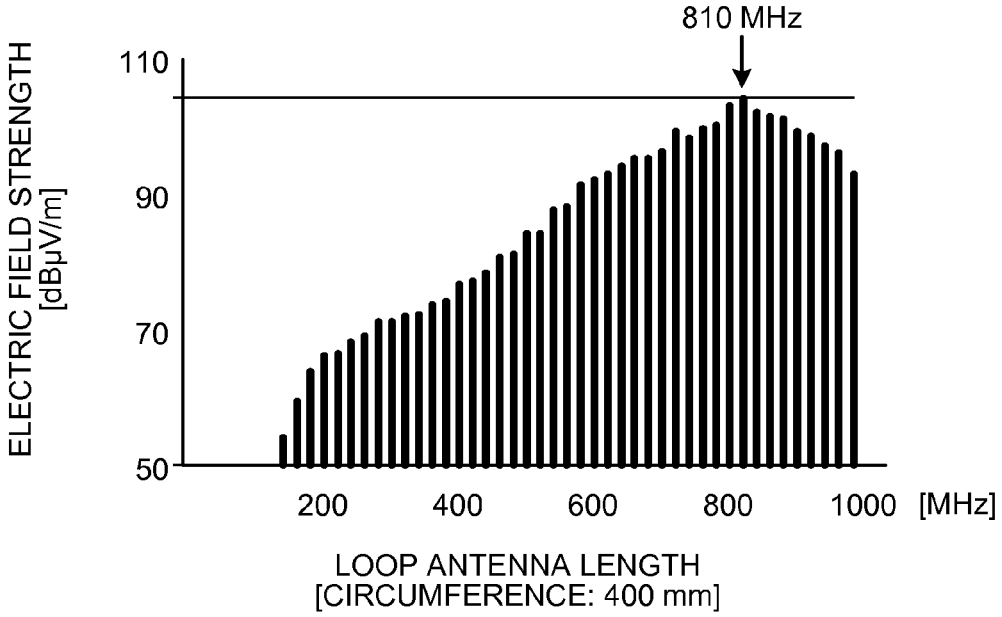
FIG. 5 is a diagram illustrating relationship between frequency and electric field strength of a loop antenna whose length is 400 mm.
Figure 6:
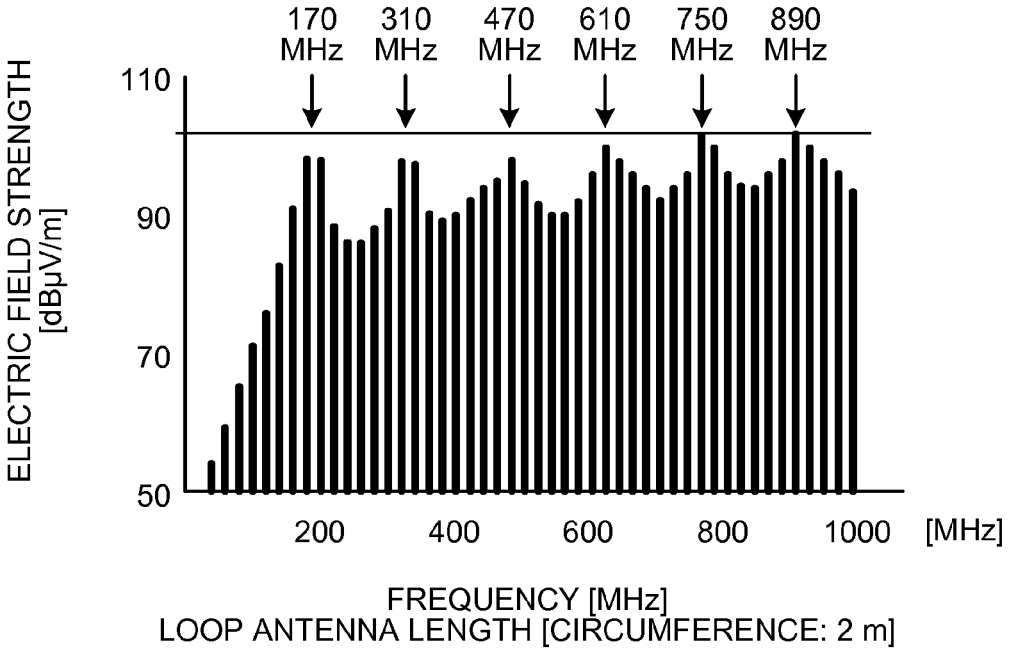
FIG. 6 is a diagram illustrating relationship between frequency and electric field strength of a loop antenna whose length is 2 m (meters).

FIG. 4 illustrates relationship between length and electric field strength of a loop antenna. When the length of the loop antenna is approximately 80 mm, the electric field strength is approximately 85 dBpV/m (decibel microvolts per meter) even at its peak. By contrast, when the length of the loop antenna is 400 mm, as illustrated in FIG. 5, a peak value of the electric field strength increases to a value as high as close to but no higher than 110 dBpV/m at approximately 810 MHz (megahertz). When the length of the loop antenna is 2 m, as illustrated in FIG. 6, peak values of the electric field strength are close to but no higher than 110 dBpV/m, which are substantially the same as that when the length of the loop antenna is 400 mm illustrated in FIG. 5. However, when the length of the loop antenna is 2 m, the electric field strength peaks at each of 170 MHz, 310 MHz, 470 MHz, 610 MHz, 750 MHz, and 890 MHz. In short, when the length of the loop antenna is 2 m, the electric field strength peaks at a number of frequencies.

From these, it is indicated that the larger the loop antenna, the higher the electric field strength of the loop antenna. It is also indicated that the smaller the shape of the loop antenna, the lower the peak value of the electric field strength. Hence, it is desired to minimize the loop antenna to prevent emission of noise such as switching noise.

As illustrated in FIGS. 4 to 6, the frequency, at which the electric field strength peaks, varies depending on the length of the loop antenna. Loop antennas have a characteristic that wavelength of a loop antenna depends on the length of the loop antenna. For this reason, if a wavelength, which is an integer multiple of a wavelength calculated from a switching frequency of the high-voltage power supply 150YM (and the high-voltage power supply 150CK), coincides with a wavelength corresponding to the length of the loop antenna, the loop antenna resonates and radiates a radio wave having the resonance frequency. However, if no integer multiple of the wavelength calculated from the switching frequency of the high-voltage power supply 150YM (and the high-voltage power supply 150CK) coincides with the length of the loop antenna, the loop antenna does not resonate and therefore does not radiate a radio wave.

A wavelength λ (in meters) corresponding to a frequency, at which the loop antenna resonates, can be calculated using the following equation:

$$\lambda = c/f$$

where f is the switching frequency in hertz and c is the speed of light, which is 300,000,000 kilometers per second.

Accordingly, if the switching frequency of the high-voltage power supply 150YM (and the high-voltage power supply 150CK) is given, the wavelength λ, at which the loop antenna resonates, can be calculated. The image forming apparatus 101 according to the embodiment includes the harness 180 made of a conductor and arranged to be shorter than a route by way of the casing of the image forming apparatus 101. Specifically, the image forming apparatus 101 according to the embodiment determines the harness length of the harness 180 from the switching frequency of the high-voltage power supply 150YM (and the high-voltage power supply 150CK), the wavelength λ corresponding to the resonance frequency of the loop antenna calculated from the equation, and the characteristic of loop antennas.

More specifically, the image forming apparatus 101 adjusts the length of the harness 180 so that a sum of the harness length of the harness connecting the high-voltage power supply 150YM to the charging device 111M and dedicated to the high-voltage application and the harness length of the harness 180 dedicated to the return line, by which the current returns from the photoconductor drum 112M charged by the charging device 111M to the high-voltage power supply 150YM, is other than a length corresponding to integer multiple wavelength of the wavelength corresponding to the switching frequency of the high-voltage power supply 150YM.

For example, the image forming apparatus 101 according to the embodiment may adjust the sum of the harness length of the harness dedicated to the high-voltage application and the harness length of the harness 180 dedicated to the current return line to be less than four times the linear distance between the high-voltage power supply 150YM and the charging device 111M. The reason for adjusting the sum to be less than the four times the linear distance is described below.

When electrically connecting a high-voltage power supply and a voltage application unit that applies a high voltage with a harness, the length of the harness can be minimized by linearly connecting the high-voltage power supply and the voltage application unit. However, it is difficult to wire, or lay out, a harness straight in a casing of a structure such as the image forming apparatus 101. Accordingly, in many cases, a harness is bent at an appropriate position(s) when wired to connect, for example, a high-voltage power supply and a voltage application unit. Furthermore, the harness is wired in a form of being bent at a right angle in many cases.

Assume that a harness length of a harness linearly connecting a high-voltage power supply and a voltage application unit is "2", a harness length of a shorter side of a harness connecting the same but bent at a right angle is "2", and a harness length of the other, longer side of the bent harness is "$\sqrt{3}$". Further assume that an end of the portion, whose harness length is "1", of the bent harness is connected to the voltage application unit, while an end of the portion, whose harness length is "$\sqrt{3}$", of the bent harness is connected to the high-voltage power supply. Hence, a right triangle whose hypotenuse is the harness whose harness length is "2" is assumed.

In this assumed right triangle, the length of the entire harness wired in the bent form is "$1+\sqrt{3}=2.7320$". When both the harness dedicated to the high-voltage application and the harness 180 dedicated to the current return line are wired along a pathway of the bent harness, the total harness length of the harness dedicated to the high-voltage application and the harness 180 dedicated to the current return line is "$(1+\sqrt{3})\times 2=5.4640$". This is 2.8 times larger than the harness length "2" of the harness corresponding to the hypotenuse of the right triangle.

Furthermore, the need of taking an allowance length for a wiring work and tolerances into account will arise when wiring the harness dedicated to the high-voltage application and the harness 180 dedicated to the current return line. For these reasons, the image forming apparatus 101 according to the embodiment adjusts the sum of the harness length of the harness dedicated to the high-voltage application and the harness length of the harness 180 dedicated to the current return line to be less than the four times the linear distance between the high-voltage power supply 150YM and the charging device 111M.

With this configuration, the photoconductor drum 112M can be connected to the high-voltage power supply 150YM with the harness 180 dedicated to the return line and of a minimum length at which resonance at the switching frequency of the high-voltage power supply 150YM does not occur. Because the harness 180 dedicated to the return line thus has the length at which resonance at the switching frequency of the high-voltage power supply 150YM does not occur, an inconvenience that the above-described loop antenna containing the harness 180 resonates at the switching frequency of the high-voltage power supply 150YM, thereby emitting noise, can be prevented.

Furthermore, the electric field strength can be reduced by reducing an inner area (i.e., loop aperture area) of the loop antenna formed by the harness dedicated to the high-voltage application and the harness 180 dedicated to the current return line. The inner area of the loop area can be reduced by reducing the circumference of the loop antenna. In the image forming apparatus 101 according to the embodiment, the harness 180 dedicated to the return line is arranged in proximity and parallel to the harness dedicated to the high-voltage application. In other words, in the image forming apparatus 101 according to the embodiment, the harness 180 dedicated to the return line is arranged so that the harness 180 follows the same path as the harness dedicated to the high-voltage application. This configuration prevents the loop antenna from being elongated due to detoured routing or the like, thereby making it possible to form the loop antenna with a minimum circumference and a small inner area. Hence, this configuration reduces the electric field strength while causing the loop shape not to exhibit the characteristic of the loop antenna, thereby preventing noise emission more effectively.

Meanwhile, if it is difficult to arrange the harness 180 dedicated to the return line so as to follow the same path as the harness dedicated to the high-voltage application, it is preferable to adopt the following configuration. That is, the lengths of the harnesses are adjusted so that the sum of the harness length of the harness dedicated to the high-voltage application and the harness length of the harness 180 dedicated to the return line is less than four times the linear distance between the high-voltage power supply 150YM to the charging device 111M. The length of the harness 180 dedicated to the return line is adjusted so as to minimize the loop area while making the sum of the harness length of the harness dedicated to the high-voltage application and the harness length of the harness 180 dedicated to the return line less than the four times the above-described linear distance.

The above description is mainly made by way of the example of the harness 180 dedicated to the return line, by which the current returns from the photoconductor drum 112M to the high-voltage power supply 150YM. However, in the image forming apparatus 101 according to the embodiment, a harness having the same configuration as the above-described harness 180 dedicated to the return line is arranged between the photoconductor drum 112Y and the high-voltage power supply 150YM. Furthermore, harnesses each having the same configuration as the above-described harness 180 dedicated to the return line are respectively arranged between the photoconductor drum 112C and the high-voltage power supply 150CK and between the photoconductor drum 112K and the high-voltage power supply 150CK. These harnesses function to prevent emission of noise as described above.

Furthermore, harnesses each having the same configuration as the above-described harness 180 dedicated to the return line are respectively arranged between the primary-transfer high-voltage power supply 151 and the primary transfer roller 114Y and between the primary-transfer high-voltage power supply 151 and the primary transfer roller 114M. Furthermore, harnesses each having the same configuration as the above-described harness 180 dedicated to the return line are respectively arranged between the primary-transfer high-voltage power supply 151 and the primary transfer roller 114C and between the primary-transfer high-voltage power supply 151 and the primary transfer roller 114K. Furthermore, a harness having the same configuration as the above-described harness 180 dedicated to the return line is arranged between the secondary-transfer high-voltage power supply 152 and the secondary transfer roller 120. These harnesses function to prevent emission of noise as described above.

As is apparent from the above description, in the image forming apparatus 101 according to the embodiment, the return line, by which a current returns from the target device where a high voltage is applied to the high-voltage power supply, is made of the harness 180. More specifically, the harness 180 has the minimum length, at which the harness 180 does not resonate at the switching frequency of the high-voltage power supply. This configuration prevents an inconvenience that the antenna equivalent (loop antenna) formed by the current path, through which the current flows between the high-voltage power supply and the target device where the high voltage is applied, resonates at the switching frequency of the high-voltage power supply and emits noise.

Furthermore, this configuration can be implemented easily only by arranging the harness 180 that forms the current return line between the high-voltage power supply and the target device where the high voltage is applied.

The conductor, of which the current return line is made, is not limited to a harness but can be any conductor. For example, the return line can be made of a member, such as a sheet metal or an EMC (Electromagnetic Compatibility)-compliant member, other than an electric wire.

For example, aspects of the present invention are applicable to any electric-current return line, by which an electric current that flows upon application of a high voltage to a target device returns to a high-voltage power supply, formed by using a casing of the target device. Even when applied as such, advantages similar to those described above can be achieved. The embodiments and various modifications of the embodiments remain within the scope and spirit of the invention and also within the appended claims and their equivalents.

An image forming apparatus according to an aspect of the present invention can reduce noise emission with a simple configuration.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a voltage application unit configured to apply a voltage;

a target device, to which the voltage is to be applied;

a voltage application line, through which the voltage is applied from the voltage application unit to the target device, the voltage application line being made of a conductor; and an electric-current return line, through which an electric current that flows upon application of the voltage from the voltage application unit to the target device returns to the voltage application unit, made of a conductor and connecting the target device to the voltage application unit, the electric-current return line having a length shorter than a path by way of a casing of the image forming apparatus.

2. The image forming apparatus according to claim 1, wherein the length of the electric-current return line is adjusted so that a sum of a length of the voltage application line and the length of the electric-current return line is other than a length corresponding to integer multiple wavelength of a wavelength corresponding to a switching frequency of the voltage application unit.

3. The image forming apparatus according to claim 2, wherein the sum of the length of the voltage application line and the length of the electric-current return line is less than four times a linear distance between the voltage application unit and the target device.

4. The image forming apparatus according to claim 3, wherein the electric-current return line is configured so as to minimize an inner area of a loop antenna formed by the voltage application line and the electric-current return line.

5. The image forming apparatus according to claim 1, wherein the electric-current return line is arranged in proximity and parallel to the voltage application line.

* * * * *